US006502569B1

(12) United States Patent
Lee

(10) Patent No.: US 6,502,569 B1
(45) Date of Patent: Jan. 7, 2003

(54) NO-VIBRATION AND NO-NOISE ROCK SPLITTER OF OIL HYDRAULIC PISTON TYPE

(75) Inventor: Sang Hyu Lee, Incheon-Kwangyockshi (KR)

(73) Assignee: Gisul Nara Co., Ltd., Kyonggi-Do (KR)

( * ) Notice: Subject to any disclaimer, the term of this patent is extended or adjusted under 35 U.S.C. 154(b) by 72 days.

(21) Appl. No.: 09/636,577

(22) Filed: Aug. 10, 2000

(30) Foreign Application Priority Data

Aug. 16, 1999 (KR) ..... 99-33663

(51) Int. Cl.[7] ..... B28D 1/13
(52) U.S. Cl. ..... 125/23.01; 125/41
(58) Field of Search ..... 125/23.01, 41

(56) References Cited

U.S. PATENT DOCUMENTS 5,102,200 A * 4/1992 Woody ..... 173/162.1
5,722,471 A * 3/1998 Fredrickson ..... 125/23.01
6,050,255 A * 4/2000 Sievert ..... 125/23.01
6,321,740 B1 * 11/2001 Scherer et al. ..... 125/23.01

* cited by examiner

*Primary Examiner*—Timothy V. Eley
*Assistant Examiner*—Alvin J Grant
(74) *Attorney, Agent, or Firm*—Schweitzer Cornman Gross & Bondell LLP

(57) ABSTRACT

A rock splitter of oil hydraulic piston type includes a housing having a plurality of cylinder chambers on the upper portion and first and second paths communicated with the cylinder chambers for supplying and discharging oil; a piston in the cylinder chamber of the housing; and a cap capable of a vertical movement, the cap being connected to the upper surface of the housing in such a manner that the inner surface thereof is in contact with the upper surface of the housing. The cap moves vertically depending on the movement of the piston. The rock splitter further comprises: a cylinder detachably mounted inside the cylinder chamber of the housing; a collapsible member having a locking member detachably mounted in the cylinder chamber, a plurality of extension members capable of a vertical extension; and an elastic member supporting the lower end of a central extension member. The entire front surface area of the cap touches the rock to maximize the power applied to the rock. Repair to the cylinder is effected by replacing only the cylinder.

4 Claims, 7 Drawing Sheets

[Fig 1]
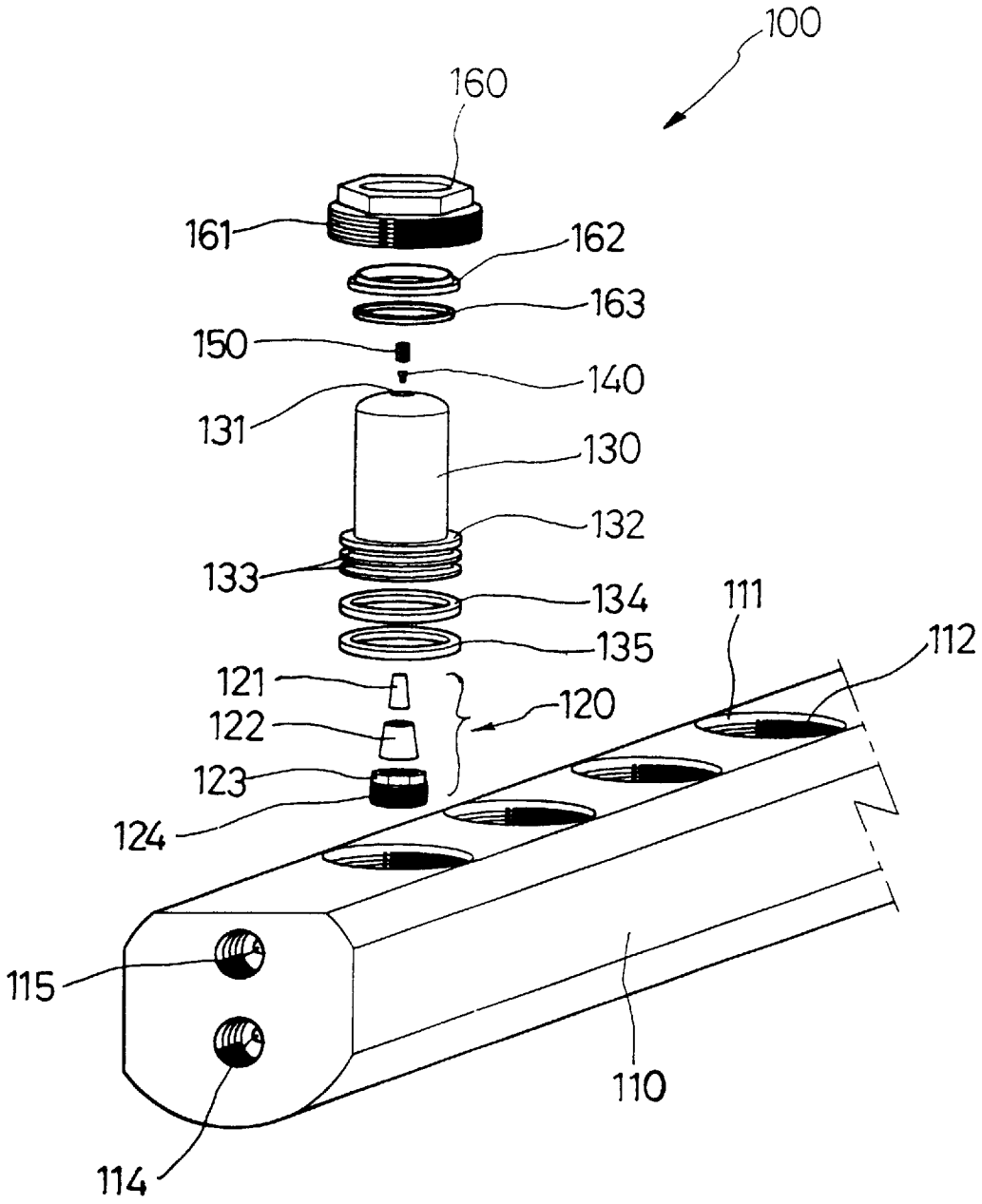

[Fig 2]
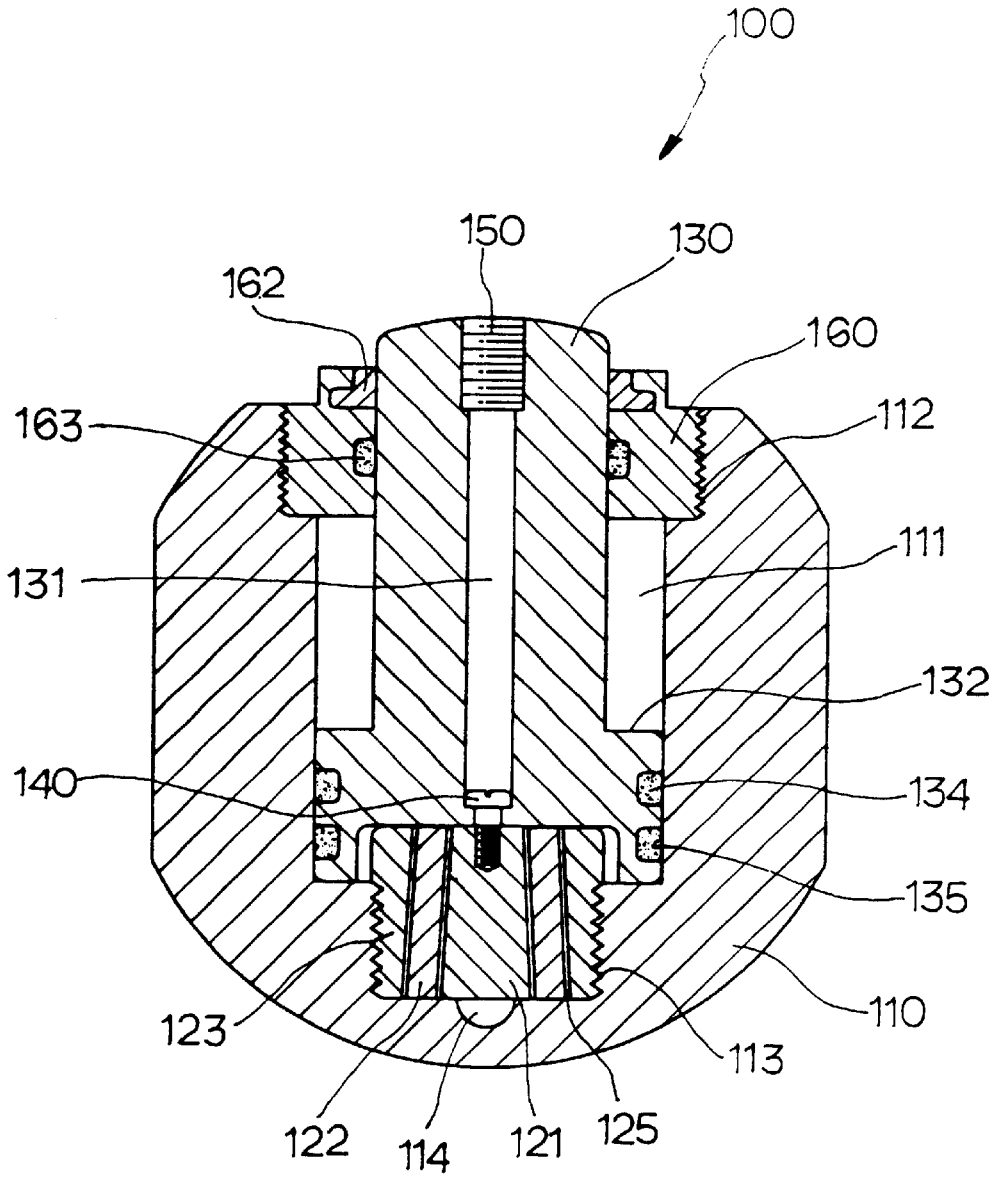

[Fig 3]
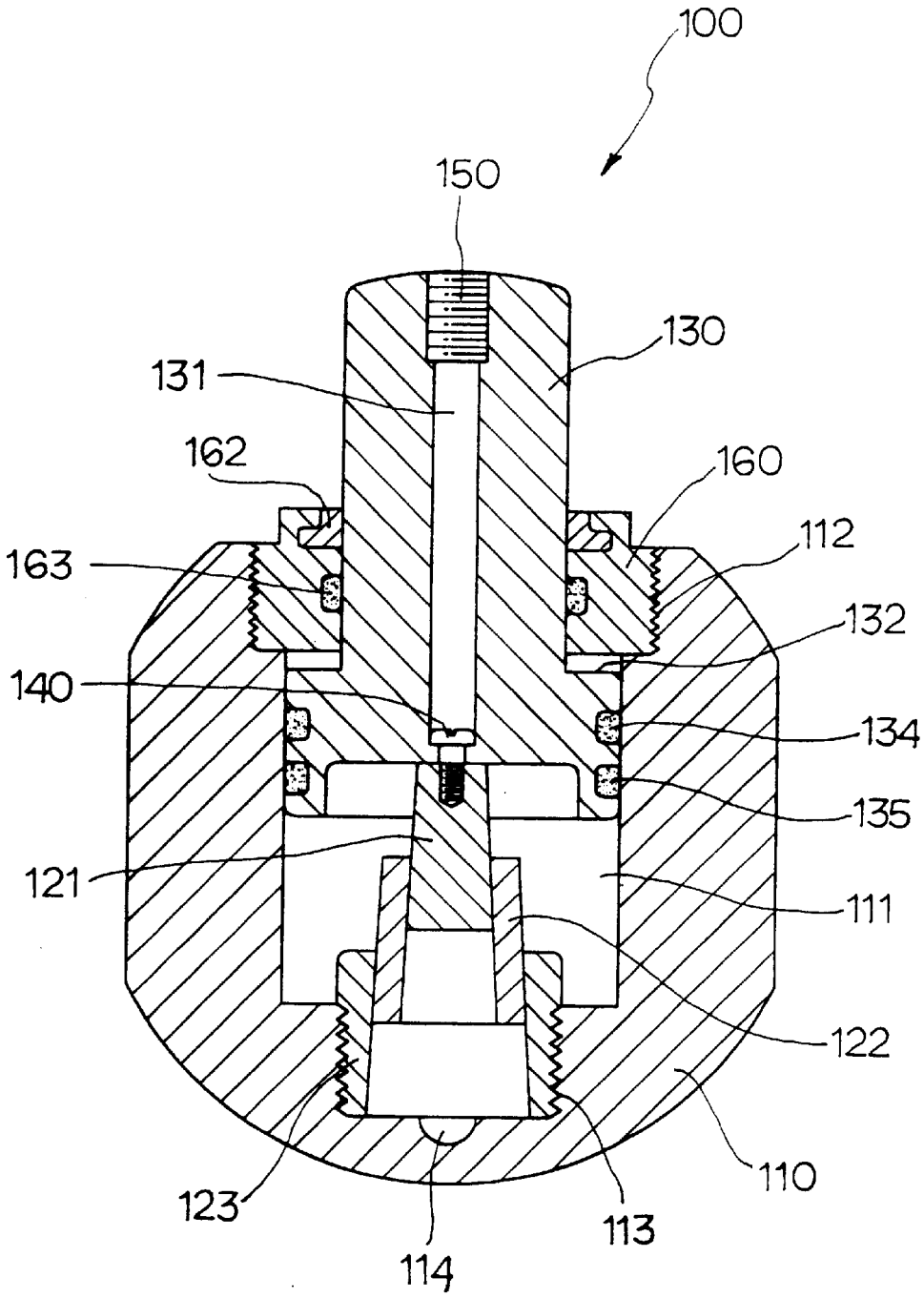

[Fig 4]
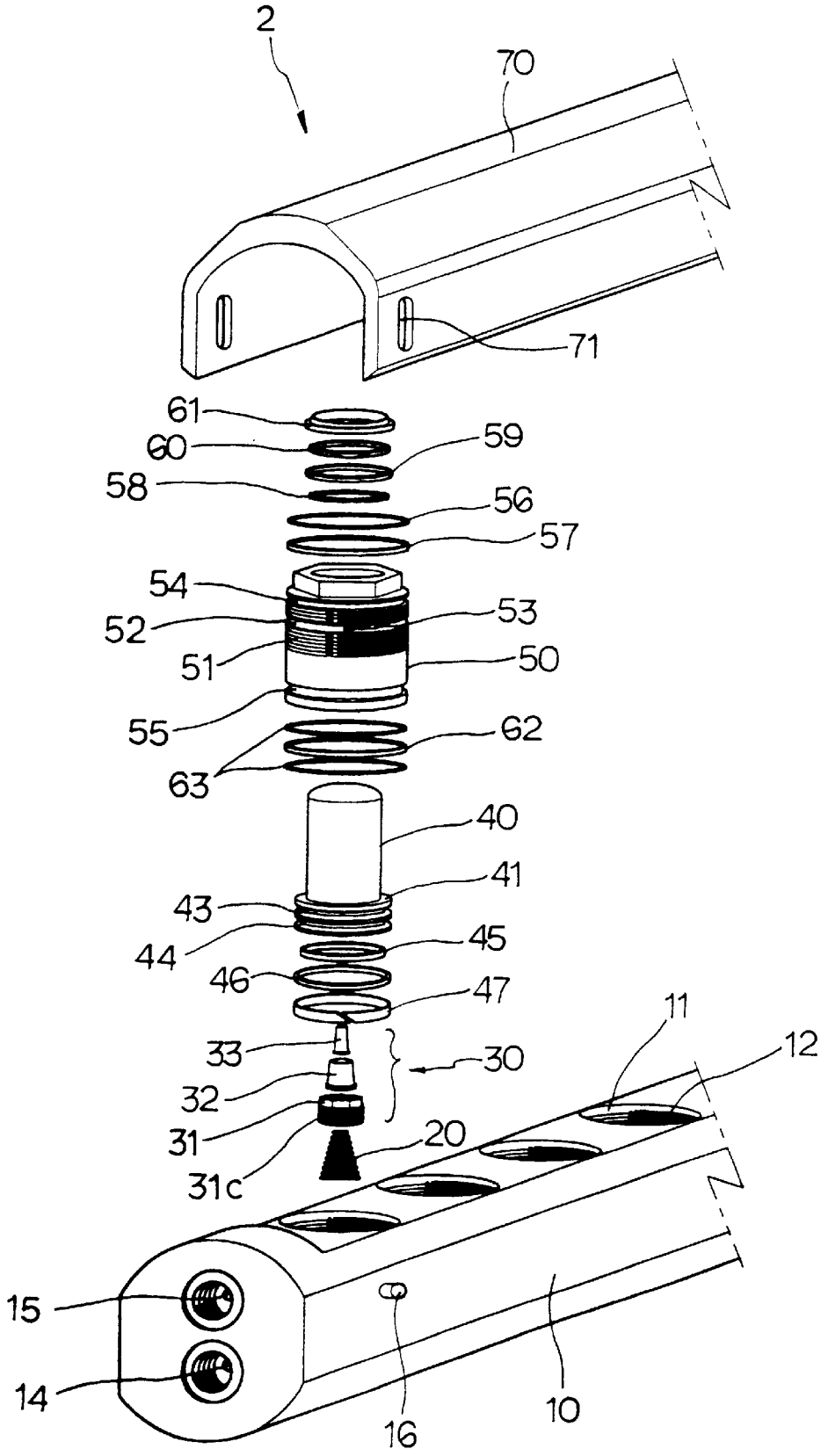

[Fig 5]
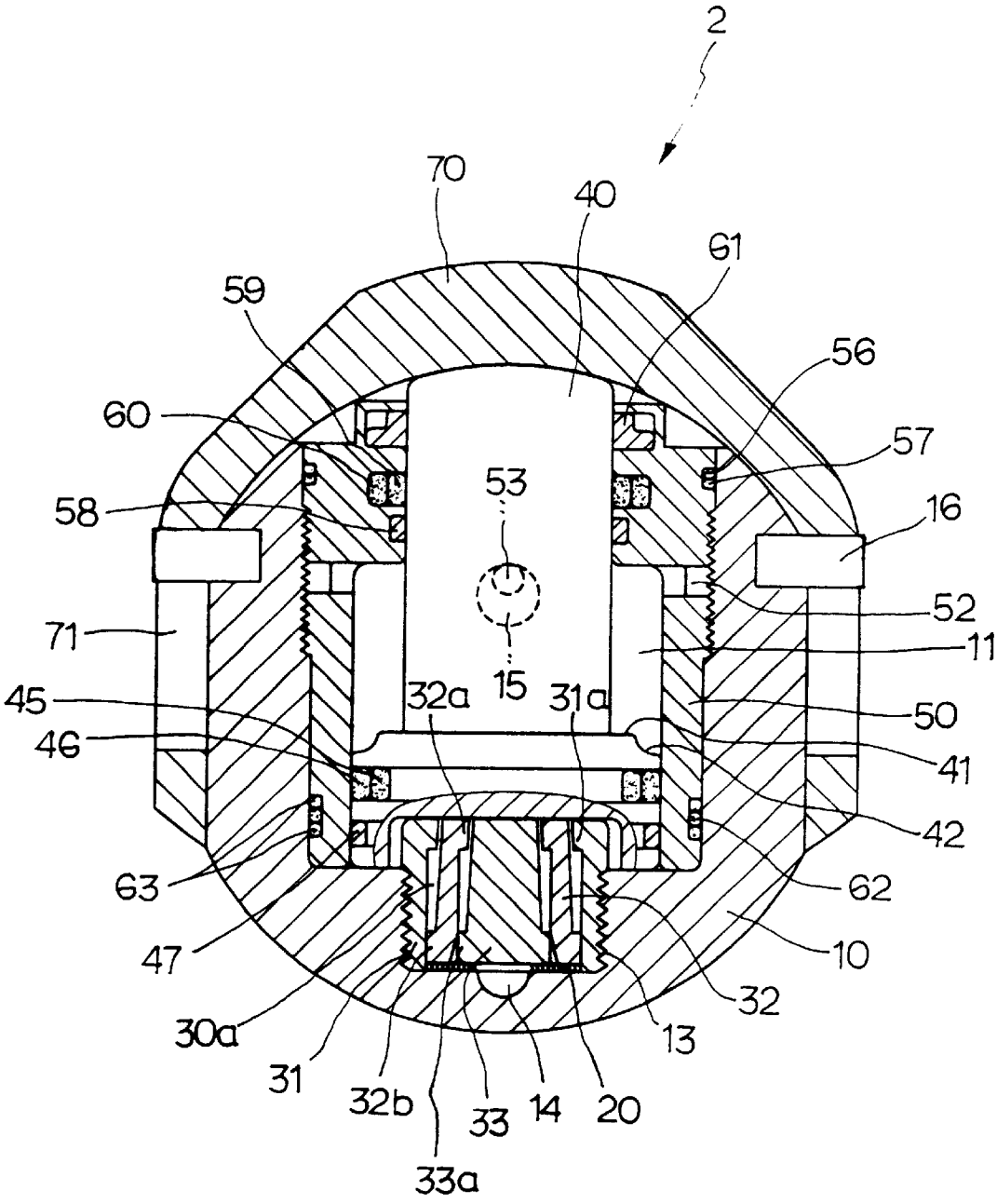

[Fig 6]
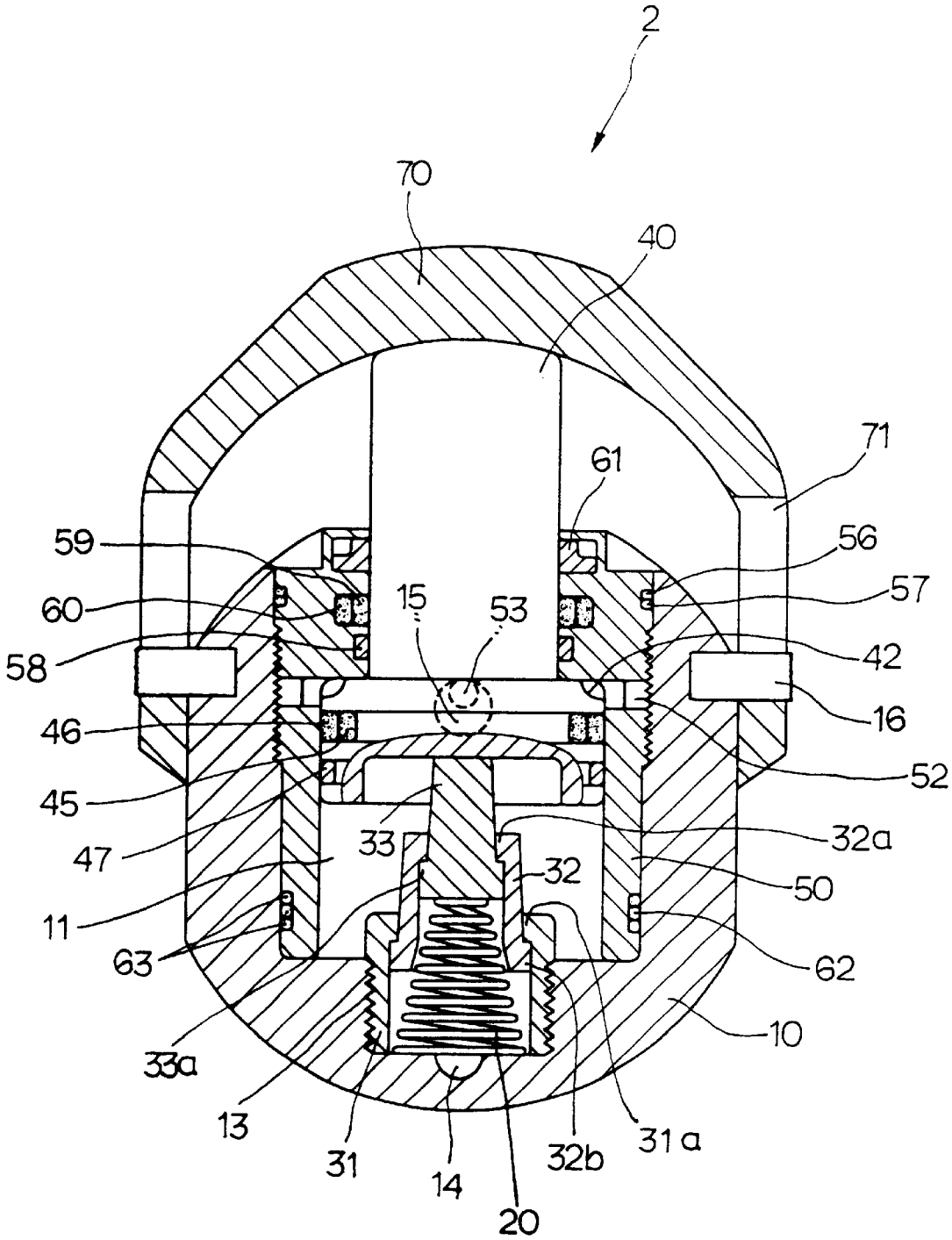

[Fig 7a]
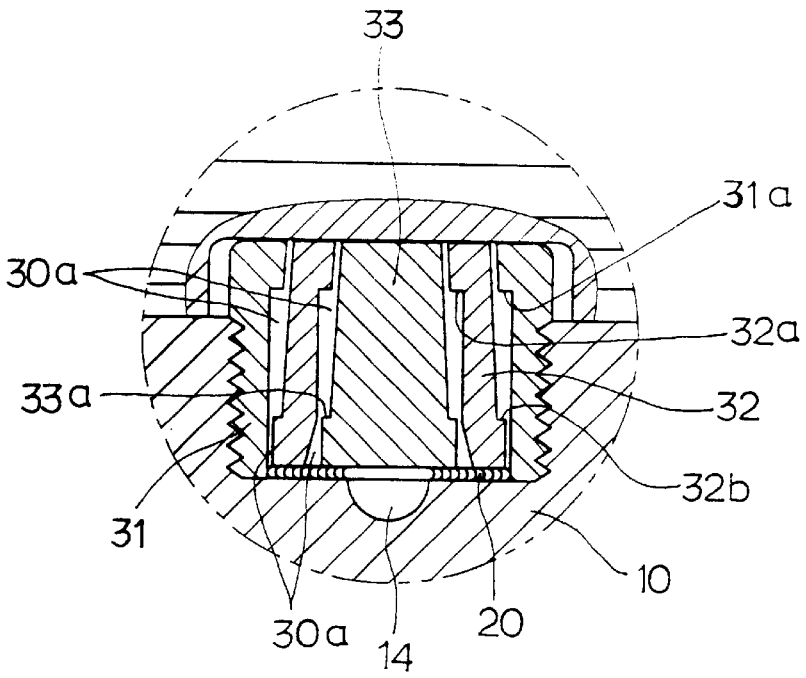
[Fig 7b]
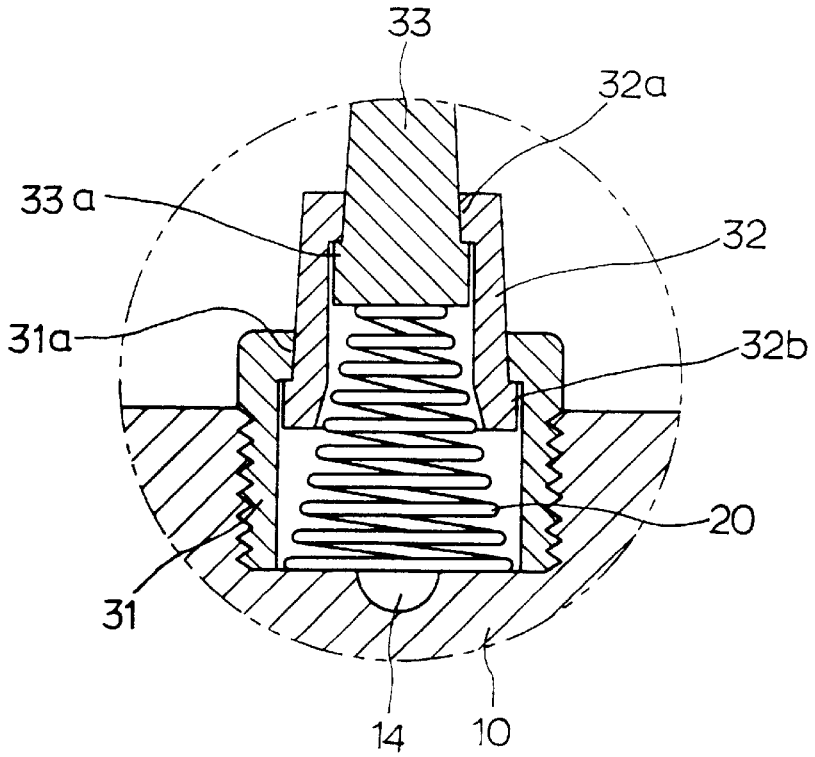

NO-VIBRATION AND NO-NOISE ROCK SPLITTER OF OIL HYDRAULIC PISTON TYPE

BACKGROUND OF INVENTION

1. Field of Invention

The present invention relates to a rock splitter of oil hydraulic piston type, and more particularly, a rock splitter of oil hydraulic piston type, in which a piston inserted into a hole perforating through rock rises and falls depending on a supply of oil.

2. Description of Prior Art

In general, a rock splitter of oil hydraulic piston type splits rock through a procedure by which a housing is inserted into a hole perforating through the rock and a piston rises and falls to split the rock when oil is supplied to the housing.

Referring to the drawings, the conventional rock splitter will be described hereinafter.

FIG. 1 is an exploded perspective view of the conventional rock splitter. FIG. 2 is a sectional view of an assembled state of the conventional rock splitter before operation. FIG. 3 is a sectional view of an assembled state of the conventional rock splitter after operation.

As shown in the drawings, The rock splitter 100 includes a housing 110 for inserting into a hole perforating through rock.

The housing 110 has an arch-shaped surface at the lower portion thereof for preventing the formation of gaps between the hole formed in the rock and the housing 110. The housing 110 further has a plurality of cylinder chambers 111 formed in the upper portion of the housing 110 at prescribed intervals, and has first and second paths 114 and 115 formed at one side portion thereof for supplying and discharging oil.

When the first path 114 is supplied with oil, a piston 130, which will be described hereinafter, is extended, and when the second path 115 is supplied with oil, the piston 130 is retracted.

Each of the cylinder 111 of the housing 110 includes a folding and unfolding means 120 capable of folding and unfolding to prevent excessive oil from being supplied inside the cylinder chamber 111 of the housing 110, thereby preventing damage to the housing 110 by overload. The folding and unfolding means 120 includes a fixing member 121 coupled with piston 130, a locking member 123 having a threaded portion 124 formed on the outer surface of the locking member 123 for engaging to a threaded portion 113 formed on the inner surface of the cylinder chamber 11, and a connecting member 122 for connecting the fixing member 121 to locking member 123.

The piston 130 is located on the folding and unfolding means 120 which is inserted into the cylinder chamber 111. The piston 130 includes a stepped portion 132 formed on a lower portion of the outer circumference thereof, a pair of grooves 133 formed on the outer surface of the stepped portion 132, first and second O-shaped rings 134 and 135 inserted into grooves 133 for preventing the outflow of oil from the cylinder chamber 111, and a hole 131 formed upper center portion of the piston 130 in which a screw 140 is inserted for connecting the piston 130 to the fixing member 121 of the folding and unfolding means 120.

In order to seal the hole 131 after screw 140 is inserted therein, a sealing member 150 is mounted on the end of the hole 131.

In order to prevent separation of the rising piston 130 from the cylinder chamber 111, a threaded portion 161 of a cylinder chamber 160 is engaged to a threaded connecting portion 112 of the cylinder chamber 111.

The cylinder chamber 160 includes a sealing member 162 which is inserted into the upper end portion from the lower end portion preventing the inflow of alien substances into the cylinder chamber 111 and a third O-shaped ring 163 inserted within the cylinder cover 160 for preventing the outflow of oil from cylinder chamber 111.

The piston 130 is formed in an arc shape at the upper end surface to facilitate maximum contact with the rock.

The conventional rock splitter 100 with the above structure is assembled into the configuration depicted in FIG. 2 through the following procedure.

The folding and unfolding means 120 comprised of the fixing member 121, the connecting member 122 and locking member 123 is inserted into cylinder chamber 111 of housing 110. The threaded portion 124 of the folding and unfolding means 120 engages the threaded portion 113 formed on the inner surface of cylinder chamber 111. The screw 140 is inserted into hole 131 of the piston in which the first and second 0-shaped rings 134 and 135 are inserted. The screw 140 is fixed to the fixing member 121 of the folding and unfolding means 120, so that the piston 130 is connected with the folding and unfolding means 120. The hole 131 of the piston 130 is sealed by this sealing member 150. After that the sealing member 162 and the third 0-shaped ring 163 fasten to the cylinder cover 160. The threaded portion 161 of the cylinder cover 160 connects to the threaded connecting portion 112 of the cylinder chamber 111, which is located on its inner circumference.

FIG. 2 a sectional view of the assembled state of the conventional rock splitter before operation. FIG. 3 a sectional view of the assembled state of the conventional rock splitter after extension of the piston 130 from the cylinder chamber 111.

When oil is supplied through the first path 114 of the housing 110, the supplied oil flows into cylinder chamber 111 through gaps formed between the members 121, 122 and 123 of the folding and unfolding member 120.

The piston 130 inserted into the cylinder chamber 111 extends due to the rising oil pressure and the extending piston 130 discharges the oil supplied inside the cylinder chamber 111 between the piston 130 and the cylinder cover 160 through the second path 115 of the housing 110.

Meanwhile, the pressure on the rock caused by the extending piston 130 splits the rock. After that, the folding and unfolding means 120 (including the fixing member 121, the connecting member 122 and the locking member 123) is expanded by the fixing member 121 connected to the piston 130 as shown in FIG. 3.

In the expanded state of the folding and unfolding means 120, as shown in FIG. 3, the gaps 125 (See FIG. 2) formed between members 121, 122 and 123 are sealed, so that oil supplied through the first path 114 is no longer supplied to cylinder chamber 111, thereby limiting the amount of oil supplied inside the cylinder chamber 111.

After splitting the rock, when oil is supplied to the second path 115 of the housing 110, the oil flows into the cylinder chamber 111 between the cylinder cover 160 and the piston 130, and thereby the rock splitter 100 is returned to its original condition. At this time, the expanded folding and unfolding means 120 is folded by retraction of the piston 130 such that the gaps 125 are again formed between the members 121,122 and 123. The oil, which is supplied within the cylinder 111 of the lower end of the piston 130 through the first path 114, is discharged through the gaps 125 to the first path 114, so that the rock splitter 100 is returned to its original condition.

However, because the piston 130 of the conventional rock splitter 100 extends inside the cylinder chamber 111 of the housing 110 by virtue of the high pressure of the oil supplied through the first and second paths 114 and 115, the piston 130 often deviates from its original position inside the cylinder chamber 111 due to the repetitive extension and retraction operation. The deviated piston 130 scratches the inner surface of the cylinder chamber 111 when the piston extends, and thereby the cylinder chamber 111 is damaged and oil leakage occurs through the gap 125 formed between the cylinder 111 and the piston 130. Therefore, the rock splitter 100 cannot perform its function, at which time the housing 110 must be replaced. Therefore, there are several disadvantages which decrease efficiency of work, while component expenses and maintenance fees increase.

It was explained that the piston 130 has the arch-shaped surface for maximizing the contact area to the rock. However, since the contact area is limited to the area of the piston 130, it is restricted to maximize the power applied to the rock.

When the folding and unfolding means 120 spreads with the rising piston 130, as shown in FIG. 3, the fixing member 121 is forcibly inserted into the connecting member 122, and the connecting member 122 into the locking member 123. At this time, too much power is required to fold the members 121, 122 and 123, so that the members 121,122 and 123 do not fold smoothly and the falling operation of the piston 130 is not performed smoothly.

SUMMARY OF THE INVENTION

Accordingly, it is an object of the present invention to overcome the disadvantages in the prior art by providing a rock splitter of oil hydraulic piston type, which includes an extra cylinder and cap, such that when the cylinder is damaged only the damaged cylinder is replaced, thereby improving efficiency of the work and reducing the maintenance fees.

It is another object of the present invention to provide a rock splitter of oil hydraulic piston type, which has a cap of an arc shape, such that the entire front surface of the cap touches the rock, thereby increasing the contact area to the rock and maximizing the power applied to the rock.

It is another object of the present invention to provide a rock splitter of oil hydraulic piston type, in which a connecting structure of members of a folding and unfolding means is improved, so that when returning to its normal state after operation, the collapsible member can be easily folded to its original condition, thereby preventing malfunction of the folding and unfolding means.

The foregoing objects are accomplished in one embodiment by providing a rock splitter of oil hydraulic piston type, which comprises a housing having a plurality of cylinder chambers formed on the upper portion and first and second paths communicated with the cylinder chambers for supplying and discharging oil; a piston inserted into the cylinder chamber of the housing, the piston rising and falling depending on the inflow of oil; and a cap being capable of vertical movement, the cap being connected to the upper surface of the housing in such a manner that the inner surface thereof is in contact with the upper surface of the housing, the cap moving vertically depending on the movement of the piston. The rock splitter further comprises: a cylinder detachably mounted inside the cylinder chamber of the housing in a sealing state; a collapsible member having a locking member detachably mounted in the cylinder chamber of the lower end of the piston, a plurality of members capable of a vertical extension, which are connected inside the locking member, inner and outer circumferences of the members having a gap for flowing the oil, and an elastic member supporting the lower end of the central member of the members and providing the elasticity to contacting the upper end of the member to the lower surface of the piston; and a plurality of stepped portions formed on the inner and outer circumferences of the members, each upper surface or lower surface of the stepped portion being in close contact with each lower surface or upper surface thereof to stop the gaps between the members and to prevent the flow of oil when the collapsible member spreads completely.

The cap is moveably mounted on the piston and has a pair to guide holes formed on opposite sides thereof. The housing has a pair of guide pins, which are formed on opposite sides thereof and slidingly inserted into the guide holes.

The cylinder includes a concave portion formed along the entire outer circumference thereof and communicated with the second path of the housing and a plurality of oil paths formed within the concave portion for allowing the oil supplied to the second path of the housing to flow into the cylinder. The piston has a concave portion formed on the upper end of a stepped portion thereof, the concave portion forming a space between the cylinder and the piston for allowing the oil to flow into the cylinder through the oil paths easily and for allowing the oil pressure to be applied to the stepped portion of the piston.

A plurality of rings are rearranged on the outer and inner surfaces of the cylinder and on the outer surface of the piston to maintain the sealing state between the cylinder chamber and the cylinder between the cylinder and the piston. Wear rings are arranged on the outer surface of the piston and on the inner surface of the cylinder to prevent lateral movement of the piston when the piston rises.

BRIEF DESCRIPTION OF THE DRAWINGS

Understanding that these drawings depict only typical embodiments of the invention and are, therefore, not to be considered limiting of its scope, the invention will be described with additional specificity and detail through use of the accompanying drawings in which:

FIG. 1 is an exploded perspective view of a conventional rock splitter;

FIG. 2 is a sectional view of the conventional rock splitter before operation;

FIG. 3 is a sectional view of the conventional rock splitter after operation;

FIG. 4 is an exploded view of the rock splitter according to the present invention;

FIG. 5 is a sectional view of the rock splitter according to the present invention before operation;

FIG. 6 is a sectional view of the rock splitter according to the present invention after operation;

FIG. 7*a* is a view of the folding and unfolding means in a folded state and FIG. 7*b* is a view of the folding and unfolding means in an unfolded state.

DETAILED DESCRIPTION OF THE INVENTION

The present invention will be described in detail hereinafter with reference to the accompanying drawings, wherein the same reference characters designate corresponding parts throughout several views. It is to be understood that these drawings depict only typical embodiments of the invention and are, therefore, not to be considered limiting in its scope.

FIG. 4 is an exploded view of the rock splitter according to the present invention; FIG. 5 is a sectional view of the rock splitter before operation; FIG. 6 is a sectional view of the rock splitter after operation. FIG. 7*a* is a view of the folding and unfolding means of the present invention in a folded state, and FIG. 7*b* is a view of the folding and unfolding means in an extended state.

As shown in the drawings, a rock splitter 2 of oil hydraulic piston type includes a housing 10 which has an arch-shaped lower surface and a plurality of concave cylinder chambers which has threaded portions 12 and 13 on its upper side.

The housing 10 further includes first and second paths 14 and 15 formed on a side surface thereof and communicated with the cylinder chambers 11 for supplying and discharging oil, and a pair of guide pins 16 protruding from opposite portion thereof.

A folding and unfolding means 30, which is comprised of a fixing member 33, a connecting member 32 and a locking member 31, is inserted into each cylinder chamber 11. The threaded portion 13 of the cylinder chamber 11 engages a threaded portion 31, and thereby the folding and unfolding means 30 is detachably mounted to the cylinder chamber 11. When the folding and unfolding means 30 is connected to the cylinder chamber 11, the folding and unfolding means 30 is inserted into the cylinder chamber 11 through the center of an elastic member 20 of a spring. The elastic member 20 is substantially formed in a conical shape wherein the upper end portion with a small diameter is in contact with the lower end of the fixing member 33 of the folding and unfolding means 30 and a lower end portion with a large diameter is placed in the cylinder chamber 11 in a compressed state.

As shown in FIG. 7*a,* the folding and unfolding member 30 has gaps 30*a* formed between the members 31, 32 and 33 for passing oil therethrough. When the folding and unfolding means 30 is expanded, the gaps 30*a* are sealed as follows. The locking member 31 has a stepped portion 31 bent inward at the upper portion. The connecting member 32 has a stepped portion 32*a* bent inward at the upper portion and a stepped portion. Also, the fixing member 33 has a stepped portion 31*a* bent outward at the lower portion. When the folding and unfolding means 30 is expanded, the stepped portions 31*a,* 32*a,* 32*b,* 33*a* of the members 31, 32, and 33 are in contact with each other to thereby seal the gaps 30*a* between the members 31,32,and 33.

In the meantime, a hollow cylinder 50 is detachably mounted on the folding and unfolding means 30 inside the cylinder chamber 11 by engaging a threaded portion 51 formed on the outer circumference of the hollow cylinder 50 to the threaded portion 12 of the cylinder chamber 11. The cylinder 50 has a plurality of rings on the inner and outer circumferences for sealing, an upper grove 54 and a lower grove 55.

In the upper groove 54 are a back-up 56 for preventing the outflow of oil and an O-shaped ring 57 for sticking the back-up ring 56 to the upper end of the upper groove 54. In the lower groove 55, an O-shaped ring 62 is located between two back-up rings 63. The back-up rings 63 are stuck to the upper and lower end of the lower groove 55 by the elasticity of the O-shaped ring 62, thereby preventing any oil leakage.

The rings inserted into the inner circumference the cylinder 50 are comprised of a (1) scraper 61 for preventing the entrance of alien substances from the outside into cylinder 50, (2) a step seal 59 arranged at the inner lower portion apart from the a scraper 61 through the center of an O-shaped ring 60 for preventing the outflow of oil from cylinder 50, and (3) a wear ring 58 attached to a piston 40 by the resilient force of the O-shaped ring 60 and arranged at the inner lower portion apart from the step seal 59 for preventing lateral movement of the piston 40 which extends and retracts within the cylinder 50.

The wear ring 58, which is made of a solid material resistive to contraction, is provided not to the seal but to guide the lifting of the piston 40, and to prevent lateral movement of the piston 40.

The piston 40 has a concave portion 52 formed on the outer circumference and communicated with the second path 15 of the housing 10. The concave portion 52 has a plurality of oil paths 53 for allowing the oil provided to the second path 15 to flow into the cylinder 50.

As shown in FIG. 4, the piston 40 is arranged inside the cylinder 50. The piston 40 has a stepped portion 41 formed at the lower portion of the outer circumference thereof and a plurality of grooves 43 and 44 formed at the outer circumference of the stepped portion 41.

A gliding ring 46 is inserted into the upper grove 43 through the center of an O-shaped ring 45 to prevent the oil leakage between the cylinder 50 and the piston 40. The gliding ring 46 is closely attached to the inner surface of the cylinder 50 by the resilient force of the O-shaped ring 45. A wear ring 47 is inserted into the lower groove 44 to guide stable vertical movement of the piston 40 without any lateral movement.

The oil supplied to the second path 15 of the housing 10 flows into the cylinder through the oil paths 53 of the concave portion 52 of the cylinder 50, which causes the piston 40 to retract. Therefore, a prescribed space is formed between the cylinder and the piston 40 to allow the oil to flow into the cylinder 50 easily. In order to easily apply the oil pressure, which flows into the cylinder 50, to the stepped portion 41 of the piston 40, a concave portion 42 is formed along the outer upper circumference of the stepped portion 41.

The rock splitter 2 with the above structure includes an arc-shaped cap 70 which is arranged in the upper portion of the piston 40. Since the cap 70 is formed in the arc shape, the entire front surface of the rock splitter 2 can touch the rock, thereby maximizing the power applied to the rock. The cap 70 has a pair of guide holes 71 formed vertically on the opposite sides of the cap 70 for inserting the guide pins 16 of the housing 10.

When the piston 40 with the arc-shaped upper surface is in contact with the inner surface of the cap 70, the cap 70 rises, and when the piston 40 retracts, the cap 70 falls by the force of gravity.

The rock splitter 2 is assembled as follows. After the large diameter portion of the elastic member 20 is seated in the cylinder chamber 11 of the housing 10, the fixing member 33 of the folding and unfolding means 30 is arranged on the upper end of the elastic member 20 in the cylinder chamber 11 and the threaded portion 31 of the locking member 31 engages the threaded spiral portion 13 of the cylinder 11.

The scraper 61, the O-shaped ring 60, the step seal 59 and the wear ring 58 are arranged on the inner surface of the cylinder 50. The back-up ring 56 and the O-shaped ring 57 are inserted into the outer upper groove 54 of the cylinder 50 and the back-up ring 63, the O-shaped ring 62 and the back-up ring 63 are inserted into the lower groove 55 of the cylinder 50 respectively.

The cylinder 50 is inserted into the cylinder chamber 11, after the piston 40 is inserted into the cylinder 50, which piston 40 has the O-shaped ring 45, the gliding ring 46 and the wear ring 47 inserted into the grooves 43 and 44 of the stepped piston 41. At this time, the threaded portion 51 formed on the outer surface of the cylinder 50 engages the threaded portion 12 formed on the inner surface of the cylinder chamber 11.

The upper portion of the piston 40 protrudes through the upper end portion of the cylinder 50. The cap 70 is situated on the upper portion of the piston 40 and the guide pins 16 of the housing 10 is inserted into the guide holes 71 of the cap 70. Through the above procedure, the rock splitter 2 is completely assembled as shown in FIG. 5.

When the oil is supplied through the first path 14 into the rock splitter 2, as shown in FIG. 7*a,* the oil flows into the cylinder 50 through the gaps 30*a,* formed between the members 31, 32 and 33 of the folding and unfolding means 30, which are placed inside the cylinder chamber 11 of the housing 10.

When the oil is continuously provided into the cylinder 50 through the gaps 30*a* of the folding and unfolding means 30, the piston 40 is raised in a state such that the piston 40 is sealed by the rings placed between the cylinder 50 and the piston 40 and prevented from moving laterally by virtue of the wear rings 47 and 58. When the piston 40 rises, the folding and unfolding means 30 is expanded by the elasticity of the member 20, and at this time, the upper surface of the fixing member 33 keeps the contact state with the bottom surface of the piston 40.

When the piston 40 rises, the oil, which flows into the space between the cylinder 50 and the stepped portion 41 of the piston 40, is discharged though the oil paths 53 of the cylinder 50 to the second path 15 of the housing 10. The cap 70, which is located on the upper portion of the piston 40, rises with the rising piston 40 through the guidance of the guide pins 16 inserted into the guide holes 71 of the cap 70.

After rising to a prescribed extent, the stepped portion of the rising piston 40 engages the inside of the cylinder 50 and thereby the piston no longer rises, the cap 70 also does not rise any more. At this time, the entire front surface of the arch-shaped cap 70 can easily split the rock by the contact area and the power applied to the rock, which are larger than that of the conventional rock splitter, thereby splitting the rock more easily. At this time, the folding and unfolding means 30 is completely expanded by the piston 40, as shown in FIGS. 6 and 7*b*.

The completely expanded folding and unfolding means 30 is in the following state. The threaded portion 31 of the locking member 31 is engaged to the threaded portion 13 of the cylinder chamber 11, the lower stepped portion 32*b* of the connecting member 32 is in contact with the upper stepped portion 32*a* of the connecting member 32, such that the gaps 30*a* between the members 31, 32 and 33 are sealed. Therefore, the oil supply through the first path 14 into the cylinder 11 blocked, thereby preventing any overload damage to the housing 10.

Meanwhile, after splitting the rock, in order to return the rock splitter 2 to its original condition, when the oil is supplied to the second path 15 of the housing 10, the oil supplied to the second path 15 flows into the cylinder 50 through the oil paths 53 of the cylinder 50. When the oil continuously flows through the concave portion 42, the piston 40 drops with the oil pressure applied to the concave portion 42.

When the piston 40 drops, the fixing member 33, being in contact with the bottom of the piston 40, is inserted into the connecting member 32 and the connecting member 32 is inserted into the locking member 31, thereby the folding and unfolding means is folded and the elastic member 20 is again compressed. When folded, the stepped portion 31*a,* 32*a,* 32*b* and 33*a,* are separated from each other and thereby, the folding and unfolding means 30 has the gaps 30*a* between the members 31, 32 and 33. Through the gaps 30*a,* the oil staying inside the lower portion of the piston 40 is discharged through the fist path 14 of the housing 10.

When the piston 40 falls down in the above manner, the cap 70 which is located on the upper end of the piston 40 is returned to its original position, being guided by the guide pins 16 inserted into the guide holes 71.

When the piston 40 rises within the cylinder 50, the wear rings 58 and 47, which are placed on the inner surface of the cylinder 50 and the outer portion of the piston 40 respectively, prevent lateral movement of the piston 40.

The rock splitter 2 according to the present invention includes another cylinder 50 inserted into the cylinder chamber 11 of the housing 10. In the conventional rock splitter 2, if the cylinder 50 is damaged by the piston 40, the entire housing 10 must be replaced. However, in the rock splitter 2 according to the present invention, only the damaged cylinder 50 is replaced without necessitating replacement of the entire housing 10, thereby reducing the maintenance fees considerably and improving the efficiency of work.

Additionally, in the conventional rock splitter, the power applied to the rock is limited to the area of the piston 40, but in the present invention, the power applied to the rock is applied to the entire front surface of the cap 70, so that the rock can be easily split, while the rising pressure of the piston 40 is maintained in the same intensity as the conventional rock splitter.

Furthermore, the folding and unfolding means 30 is expanded while the gaps 30*a* between members 31, 32 and 33 are sealed by the engagement of the stepped portions 31*a,* 31*b,* 32*b* and 33*a*. When returning to its original position, the members 31, 32 and 33 are easily returned to their original positions by a small amount of oil pressure passing through the stepped portions, thereby preventing malfunction of the folding and unfolding means 30.

Those skilled in the art will readily recognize that these and various other modifications and changes may be made to the present invention without strictly following the exemplary application illustrated and described herein, and without departing from the true spirit and scope of the present invention, which is set forth in the follow claims.

What is claimed is:

1. A rock splitter of oil hydraulic piston type which comprises a housing having a plurality of cylinder chambers formed on the upper portion and the first and second paths communicates with the cylinder chambers for supplying and discharging oil; a piston inserted into the chamber of the housing, the piston rising and falling depending on the inflow of oil; and a cap being capable of a vertical movement, the cap being connected to the upper surface of the housing, in such a manner that the inner surface thereof is in contact with the upper surface of the housing, the cap moving vertically depending on the movement of the piston, wherein the rock splitter further comprises:

a cylinder detachably mounted inside the cylinder chamber of the housing in a sealing state;

a collapsible member having a locking member detachably mounted in the cylinder chamber of the lower end of the piston, a plurality of members capable of a vertical extension, which are connected inside the locking member, inner and outer circumferences of the members having a gap for flowing oil, and an elastic member supporting the lower end of the central member of the members and providing the elasticity to contacting the upper end of the member to the lower surface of the piston; and a plurality of stepped portions formed on the inner and outer circumferences of the members, each upper or lower surface of the stepped portion being in close contact with each lower surface or upper surface thereof to stop the gaps between the members and to prevent the flow of oil when the collapsible member spreads completely.

2. A rock splitter of oil hydraulic piston type as claimed in claim 1, wherein the cap is movably mounted on the piston, wherein the cap has a pair of guide holes formed on opposite sides thereof, and wherein the housing has a pair of guide pins, which are formed on opposite sides thereof and slidingly inserted into the guide holes.

3. A rock splitter of oil hydraulic piston type as claimed in claim 1, wherein the cylinder includes a concave portion formed along the entire outer circumference thereof and communicated with the second path of the housing and a plurality of oil paths formed within the concave portion for allowing the oil supplied to the second path of the housing to flow into the cylinder, and wherein the piston has a concave portion formed on the upper end portion of a stepped portion thereof, the concave portion forming a space between the cylinder and the piston for allowing the oil to flow into the cylinder through the oil paths easily and for allowing the oil pressure to be applied to the stepped portion of the piston.

4. A rock splitter of oil hydraulic piston type as claimed in claim 1, wherein a plurality of rings are arranged on the outer and inner surfaces of the cylinder and on the outer surface of the piston to maintain the sealing state between the cylinder and the piston, and wherein wear rings are arranged on the outer surface of the piston and on the inner surface of the cylinder to prevent lateral movement of the piston when the piston rises.

* * * * *